US005860363A

United States Patent [19]

Childers et al.

[11] Patent Number: 5,860,363

[45] Date of Patent: Jan. 19, 1999

[54] INK JET CARTRIDGE WITH SEPARATELY REPLACEABLE INK RESERVOIR

[75] Inventors: Winthrop D. Childers, San Diego, Calif.; Bruce Cowger, Corvallis, Oreg.

[73] Assignee: Hewlett-Packard Company, Palo Alto, Calif.

[21] Appl. No.: 785,103

[22] Filed: Jan. 21, 1997

[51] Int. Cl.[6] ..... B41J 2/175

[52] U.S. Cl. ..... 101/483; 347/7; 347/86

[58] Field of Search ..... 347/7, 85, 86, 347/87; 101/483

[56] References Cited

U.S. PATENT DOCUMENTS

| | | | |
|---|---|---|---|
| 4,568,954 | 2/1986 | Rosback . | |
| 5,008,688 | 4/1991 | Ebinuma et al. | 347/86 |
| 5,049,898 | 9/1991 | Arthur et al. . | |
| 5,132,711 | 7/1992 | Shinada et al. | 347/86 |
| 5,138,344 | 8/1992 | Ujita | 347/86 |
| 5,155,502 | 10/1992 | Kimura et al. . | |
| 5,414,452 | 5/1995 | Accatino et al. . | |
| 5,473,350 | 12/1995 | Mader et al. | 347/86 |
| 5,506,611 | 4/1996 | Ujita et al. . | |
| 5,552,816 | 9/1996 | Oda et al. | 347/86 |
| 5,610,635 | 3/1997 | Murray et al. . | |
| 5,617,121 | 4/1997 | Tachihara et al. | 347/7 |
| 5,635,961 | 6/1997 | Sato | 347/7 |
| 5,675,367 | 10/1997 | Scheffelin et al. | 347/86 |

FOREIGN PATENT DOCUMENTS

0720916A2 7/1996 European Pat. Off. .

*Primary Examiner*—Eugene Eickholt

[57] ABSTRACT

A replaceable ink cartridge for an ink jet printer having an ink supply station with an ink receptacle and an electric connector. The cartridge includes a chassis removable from the ink supply station, and having an ink passage and an electrical connector connectable to the printer's electric connector. An ink reservoir is removably connected to the chassis, and has a chamber containing a supply of ink. The reservoir has an ink outlet registered with the ink passage, and the chassis has an ink level annunciator connected to the cartridge's electrical connector, for generating a signal to enable printing after the ink reservoir is depleted and replaced with a second reservoir.

18 Claims, 5 Drawing Sheets

INK JET CARTRIDGE WITH SEPARATELY REPLACEABLE INK RESERVOIR

FIELD OF THE INVENTION

This invention relates to ink jet cartridges, and more particularly to two-part ink jet cartridges with separate ink supplies.

BACKGROUND AND SUMMARY OF THE INVENTION

A typical ink jet printer has a pen that reciprocates over a printable surface such as a sheet of paper. The pen includes a print head having an array of numerous orifices through which droplets of ink may be expelled into the surface to generate a desired pattern. Some ink jet printers have a replaceable ink supply mounted to a stationary position on the printer, and connected to a reciprocating print head by a conduit. This permits the use of a larger ink supply, and avoids the need to replace the print head each time the supply of ink is depleted. Color ink jet printers generally have a multi-chamber cartridge, or several ink supply cartridges each containing a different color of ink.

Some existing systems provide each stationary ink supply cartridge with an on board electronics memory chip to communicate information about the contents of the cartridge. It may also be possible for such a chip to serve as a "gas gauge" that indicates or transmits to the printer the amount of ink remaining, so that the printer does not continue printing with an empty cartridge.

The on board memory in an ink cartridge may also serve to record or store other information about the ink cartridge, such as manufacture date (to ensure that excessively old ink does not damage the print head,) ink color (to prevent misinstallation,) and product identifying codes (to ensure that incompatible or inferior source ink does not enter and damage other printer parts.)

However, for very low cost applications, these advantages provided by a memory chip in each disposable cartridge may be outweighed by the cost of replacing the chip every time a cartridge is depleted. In addition, there may be other elements in a cartridge, such as structural, plumbing, and pumping components, that have useful lives that extend well beyond the time it takes to deplete the ink supply. Yet even with separate chips and ink supply elements, simply replacing or refilling the ink supply portion of an existing cartridge will not enable its operation, as the existing memory chip may continue to indicate a depleted or beyond-shelf-life cartridge, causing the printer to refuse to proceed to avoid risk of damage or faulty output. Therefore, there is a need for a low cost ink jet printing system that permits retaining non-depleted elements of an ink cartridge while restoring an ink supply, for a printer that has sensors to avoid using a depleted or dated cartridge.

The present invention overcomes or reduces the disadvantages of the prior art by providing a replaceable ink cartridge for an ink jet printer having an ink supply station with an ink receptacle and an electrical connector. The cartridge includes a chassis removable from the ink supply station, and having an ink passage and an electrical connector connectable to the printer's electrical connector. An ink reservoir is removably connected to the chassis, and has a chamber containing a supply of ink. The reservoir has an ink outlet registered with the ink passage, and the chassis has an ink level annunciator connected to the cartridge's electrical connector, for generating a signal to enable printing after the ink reservoir is depleted and replaced with a second reservoir.

DETAILED DESCRIPTION OF A PREFERRED EMBODIMENT

Figure 1:
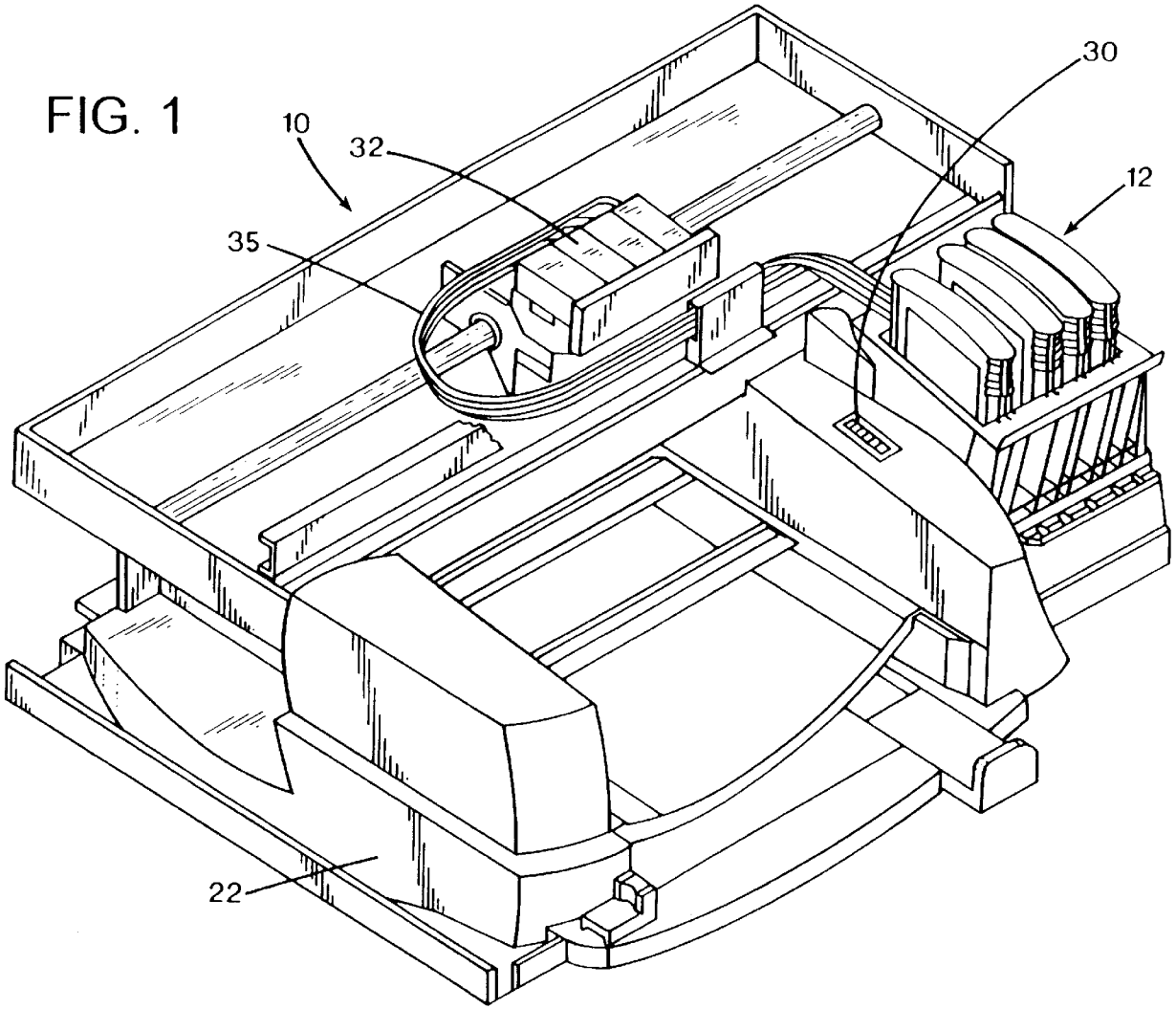
FIG. 1 is a perspective view of a printer according to a preferred embodiment of the invention.
Figure 2:
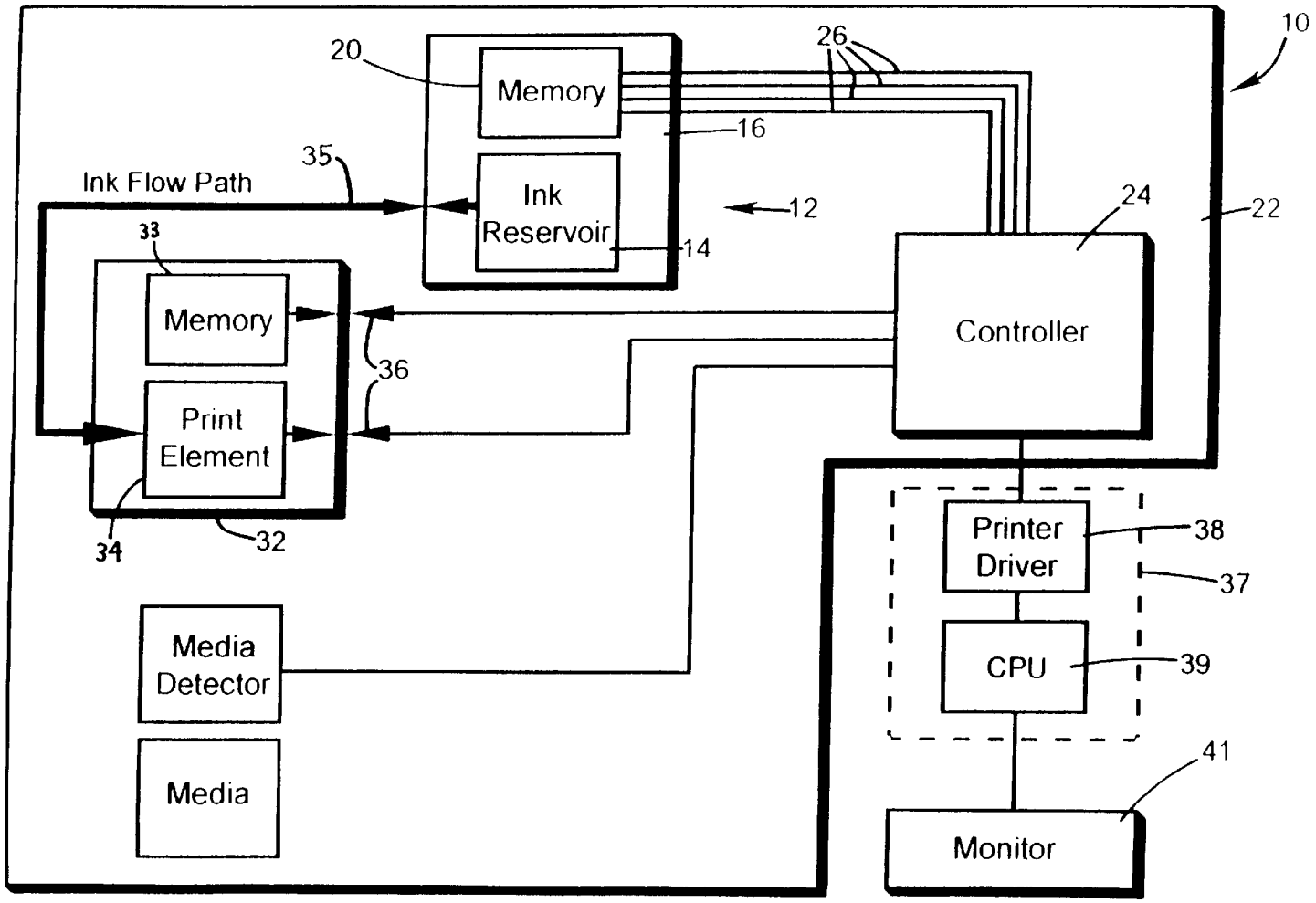
FIG. 2 is a simplified block diagram of the embodiment of FIG. 1.

FIGS. 1 and 2 shows an ink jet printing system 10 having a removable ink cartridge 12 for printing onto a sheet of media. The ink cartridge includes an ink reservoir 14 defining a chamber filled with ink, and a chassis 16 that includes a cartridge memory chip 20. The printer has a housing 22 enclosing a controller 24 connected to the cartridge chip 20 via four electrical lines 26. An ink level display 30 is mounted to the housing and electrically connected to the controller as shown, or may be displayed on the user's video display terminal by computer software. A print head 32 having a memory 33 and a print element 34 reciprocates within the housing adjacent to the sheet of media. An ink tube 35 connects the ink supply to the print head 32, providing ink for printing. A print head control bus 36 electrically connects the controller 24 to the print head 32, and transmits printing data to the print head. While the schematic is shown as having a single print head 32 and a single ink cartridge 12 for simplicity, the preferred embodiment has four of each element, each corresponding to a particular ink color (black, cyan, yellow, and magenta.) A computer 37 connected to the printer 10 includes a printer driver 38 connected to the controller 24, a central processing unit 39, and a connected monitor 41.

Figure 3:
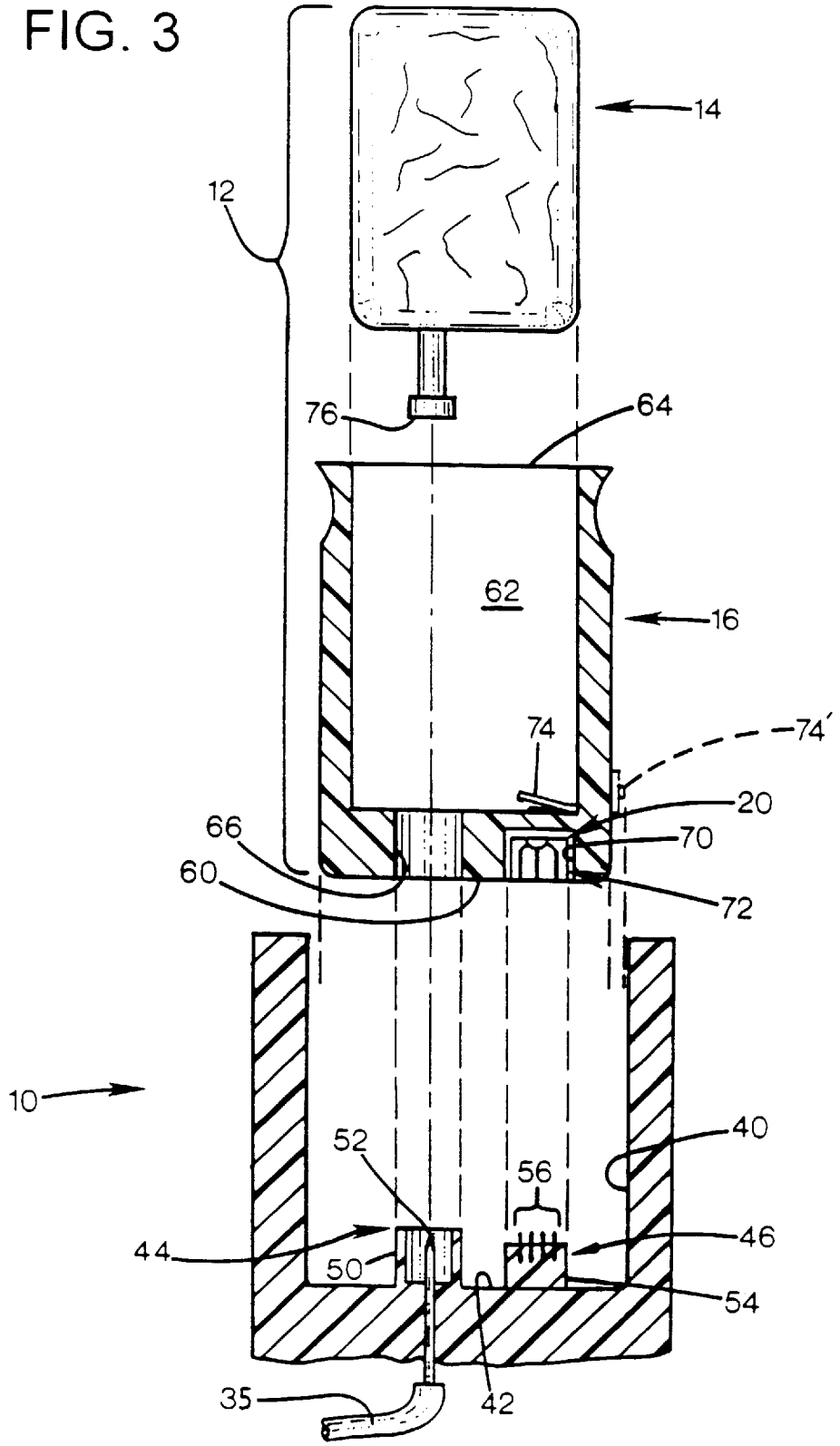
FIG. 3 is a simplified, exploded sectional view of the embodiment of FIG. 1.

FIG. 3 shows how the components 14, 16 of the ink cartridge 12 are removably connectable to the printer 10. The printer defines an ink supply station 40 that is fixed relative to the printer housing, and having a cavity which provides a receptacle to entirely receive the ink cartridge 12. The station cavity has a floor 42 upon which are mounted a fluid interconnect 44 and a printer electrical interconnect 46. The fluid interconnect includes an alignment sleeve 50 surrounding a hollow needle 52, with the needle defining a passage connecting to the ink tube 35. Although not shown in detail, the needle is provided with an enclosure to maintain humidity when an ink cartridge is not installed.

The printer electrical interconnect 46 includes a protruding boss 54 having four pins 56 formed to present laterally extending bent portions. The fluid and electrical interconnects are spaced apart from each other to prevent unexpected ink leakage from encountering the electrical elements.

The chassis portion 16 of the ink cartridge 12 is a rigid rectangular shell having a flat, planar aspect parallel to the plane of the figure. The chassis has a leading edge 60 extending toward the floor 42 of the cavity. The chassis is largely hollow, as it defines a reservoir chamber 62 that is open on a trailing edge 64 of the chamber. An ink passage 66 provides an opening from the reservoir chamber 62 through the leading edge 60, in registration with the alignment sleeve 50 for mating therewith. A pocket 70 is defined in the leading edge 60 of the chassis at a position spaced apart from the ink passage 66. A cartridge electrical connector 72 having four separate, conductive planar conductors is mounted to one wall of the pocket, so that is parallel to the plane of the ink cartridge. This permits the printer's interconnect pins 56 to scrape along the respective pads as the cartridge is inserted into the cavity of the ink supply station 40, removing any oxidation or contamination from the pads to ensure proper ohmic contact. The chassis 16 includes a memory chip 20 integral with or beneath the cartridge electrical connector 72 and having connections to each of the four connector pads.

A leaf spring reset switch 74 within the chamber 62 is also connected to the memory element 20 for sending a signal to the memory element when an ink reservoir 14 is reseated in the chamber 62 closing the switch. An alternative reset switch 74' may be mounted to the exterior of the chassis for manual actuation by a user upon replacement of an ink reservoir 14.

The ink reservoir 14 is a planar body defining an ink chamber. Preferably, the bag has sufficient flexibility to permit it to collapse to a thin, planar condition as its contents are depleted. Alternatively, it may have a thin, rigid shell to permit it to be readily inserted into and removed from the chassis chamber 62, with a collapsible bag inside, or with valved vents that permit pressure equalization with the outside atmosphere as ink is consumed. At the leading edge of the ink reservoir 14, an ink outlet 76 protrudes from a position in registration with the ink passage 66 of the chassis and with the needle 52 of the fluid connection 44. The ink outlet 76 has an end face sealed by a self-sealing septum that may be penetrated by the needle 52. The exterior of the ink outlet 76 is shaped to be closely received within and supported by the ink passage 66 to provide registration during installation of the entire cartridge in the printer.

The printer controller 24 is programmed to keep track of printing activities to maintain an estimate of how much ink has been consumed from each print cartridge 12. Essentially, this may be thought of as a drop counter. Normally, the memory chip 20 on the cartridge chassis serves as the storage site for the drop usage information. The memory of the chip may begin with an "ink full" condition value, which is decremented as printing proceeds, until an "ink empty" state is reached, whereupon the printer will not function until the cartridge is replaced with one indicating "ink full" or an intermediate condition.

By storing this information on each cartridge, cartridges may be removed and replaced without losing usage information. As printing proceeds, the printer reads the usage information stored on the cartridge memory, and displays a corresponding output on the display 30, which may be in the form of a bar graph or "gas gauge." Unlike a fuel gauge in an automobile, such a gauge does not need to sense the current fluid level in the reservoir, so that complicated ink level sensors are not needed.

In the preferred embodiment, the memory chip 20 is an EEPROM that may be written to or decremented as ink usage proceeds. Upon complete depletion, the chip must be reset, either by release and reactuation of the leaf spring switch 74 when an ink reservoir 14 is replaced, or by manual actuation of switch 74'. In the preferred embodiment, the chip 20 and cartridge electrical connector 72 have four lines: power, ground, clock, and input/output. The chip may be an MROM that is never written to, or may include a combination of MROM, EPROM, and EEPROM portions, to emulate the performance of a standard chip. In one embodiment, the drop counter may have an 8-bit write-once memory location, with each bit corresponding to one-eighth of the ink supply, and written to after a fine counter tallies a usage of a quantity of ink droplets equivalent to one-eighth the cartridge capacity.

Each cartridge memory chip 20 may include factory-recorded information such as cartridge volume, day of manufacture, year of manufacture, freshness/expiration date, ink shelf life, and product serial number. The memory may also include ink chemistry and colorimetry data, and information on ink drying time and outgassing rate to enable optimized printing during the life of the cartridge. The chip is also occasionally written to by the printer in conjunction with usage. Such information may include a coarse usage indication in eighths of the total volume, a fine drop count, first usage date, most recent usage date, and duration of time in use.

Figure 4:
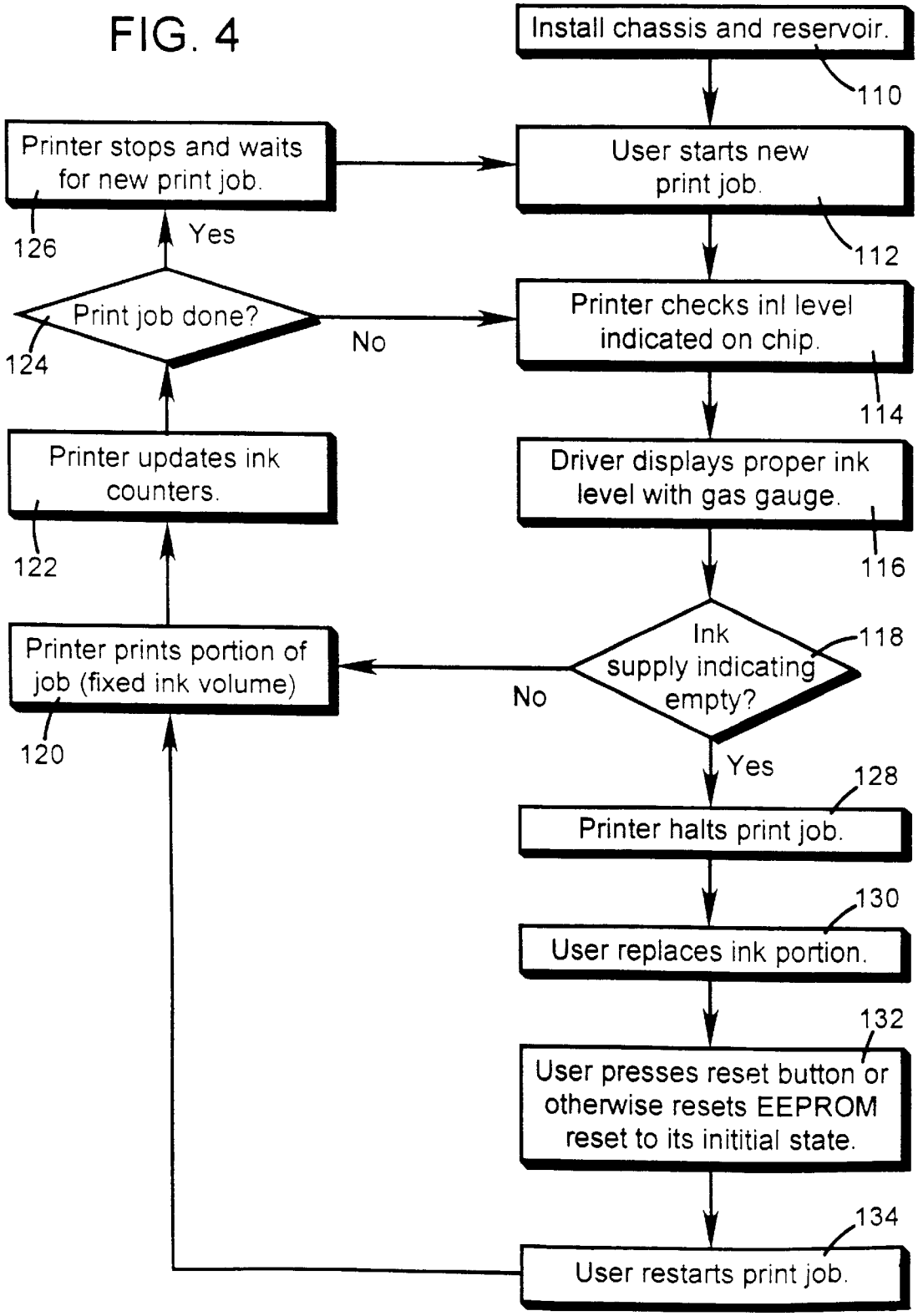
FIG. 4 is a flow chart illustrating a method of operation of the embodiment of FIG. 1

The preferred method of operation is shown in FIG. 4. Before printing, the printer is turned on, and the driver and firmware of the printer read the ink level or drop volume from each cartridge memory chip. If a cartridge is absent, the printer will not print, and the user may be notified of the need to install a cartridge. Each time a different cartridge is installed, the contents of the cartridge memory are read into a memory cache associated with the printer controller.

Operation begins with installation 110 of the chassis 16 and the ink reservoir 14, which have previously been connected to each other. The user then initiates a new print job 112, causing the printer to query 114 the cartridge memory chip 20 to determine the amount of ink in the the ink reservoir 14. The controller 24 calculates an ink level based on the received data, and sends a signal to the display 30 to indicate 116 the ink level to the user. The controller 24 assesses 118 whether the ink supply is empty.

If the ink supply is not empty, the printer prints 120 a portion of the printing job, and updates 122 the memory chip 20 to reflect the ink usage during that printing step. This may include writing to a fine counter on the cartridge memory, and if the fine counter becomes full, writing to one of the coarse counter bits and resetting the fine counter to zero for subsequent printing. The printer then determines 124 whether the print job is complete. If so, the printer stops and awaits 126 instructions to begin a new printing job, whereupon the printer proceeds to step 112 to start the new job. During the print job, at the end of printing each sheet in the job, the controller 24 will read all memory elements to update the displays reflecting ink supplies. This will permit user monitoring of ink consumption during large print jobs. If step 118 determines that the ink supply is empty, the printer halts 128 the print job, and indicates on the display 30 that the ink supply is empty. To proceed, the user must replace 130 the ink reservoir 14. Preferably, this involves removing the entire ink cartridge 12, then removing the depleted ink reservoir from the chassis 16 and replacing it with a full ink reservoir. If the chassis 16 lacks a leaf spring-type reset switch to provide a reset signal 132, the user manually actuates the reset button 74'. Then, the entire cartridge 12 is installed in the ink supply station 40, so that the needle 52 penetrates the septum to provide ink flow, and so that the printer electrical connector 46 makes contact with each of the four pads on the cartridge electrical connector 72. In an alternative method, the user may retain the depleted ink reservoir 14, and refill it with ink by injecting ink from a hypodermic needle or other source.

Resetting the memory chip 20 causes the chip to erase ink depletion data or, alternatively, to rewrite data reflecting remaining ink quantity. In either event, the memory is returned to a condition equivalent to an "ink full" condition, so that printing may proceed, and ink volume remaining may be properly displayed and updated during subsequent printing. Resetting may be achieved either by changing the coarse count and/or the fine count, and by changing the other recorded data relating to manufacture, expiration, and usage dates.

After the ink cartridge 12 is replaced, the printing job is restarted 134.

Figure 5:
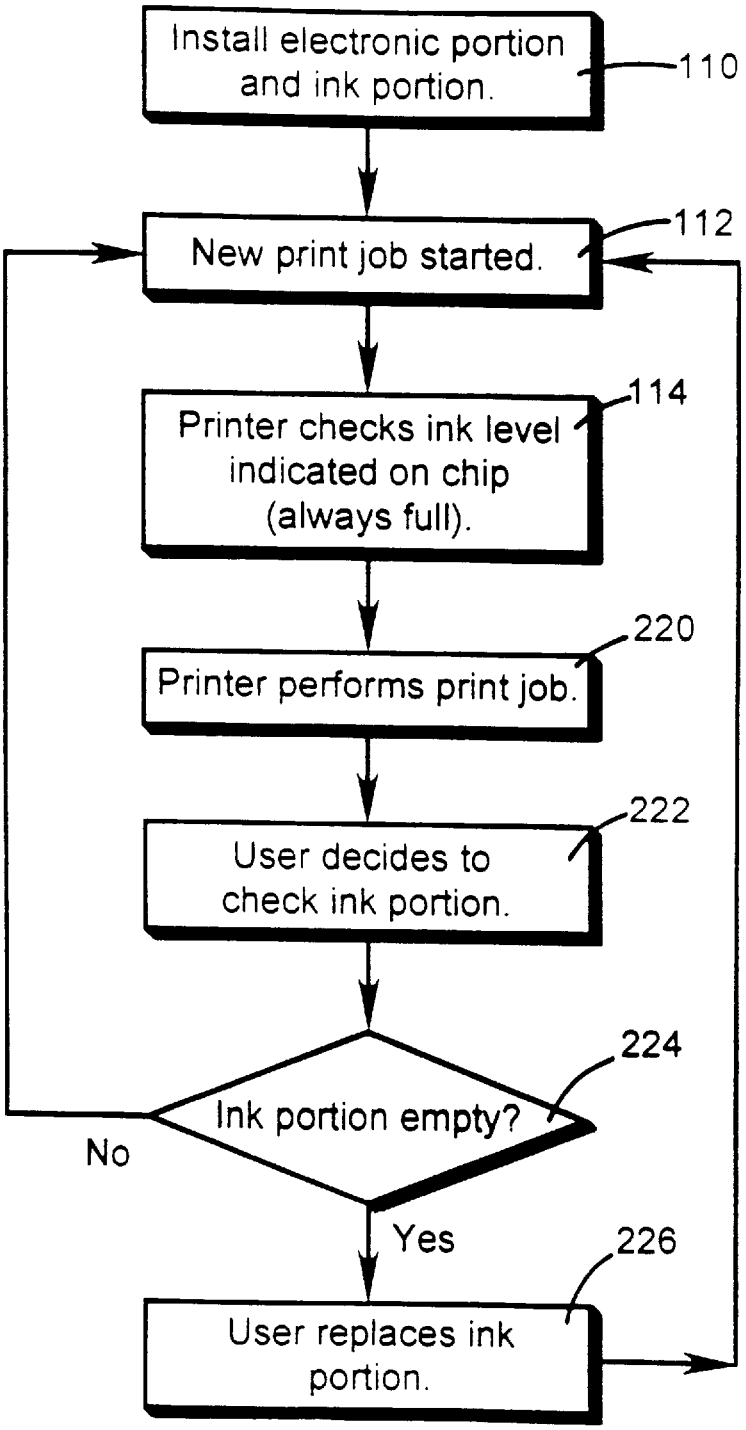
FIG. 5 is a flow chart illustrating an alternative method of operation of the embodiment of FIG. 1.

An alternative printing operation is shown in FIG. 5. In this embodiment, the ink cartridge 12 may have a simpler ROM chip 20 instead of the EEPROM. The chip is programmed to constantly provide an "ink full" signal to the printer, preventing the printer from shutting down due to depleted ink. Thus, when the printer checks the chip for ink supply level, it reads the "all full" signal, and proceeds to print 220 the entire job, or portions of the job after occasionally rechecking the ink level. In this embodiment, the printer will proceed until the ink supply runs dry, so the user may occasionally determine 222 whether there is ink in the ink reservoir 14, typically by ensuring that printed pages are being output properly. If the ink supply is empty 224, the user may replace 226 or refill the ink supply, and start a new print job. If the supply is not empty, printing may proceed without replacement.

In a variation on the FIG. 5 embodiment, a printer may have a less sophisticated level detection process that only senses whether the cartridge is empty or not, without determining the current level for display. In such a system, the printer may print as long as one of the chip outputs is maintained at a given voltage level, and will stop printing when the output voltages change to a different level. For such an application, the chip 20 may be eliminated from the cartridge chassis 16, and the output pad of the cartridge electrical connector 72 hardwired, either to the ground or voltage input to provide a continual signal corresponding to "ink full." Thus, the printer will attempt to write the droplet usage information to decrement a counter, but the output voltage will remain unchanged.

In alternatives to the FIG. 4 embodiment, the chip may have additional circuitry to automatically reset the ink level whenever the counter reaches empty, or the user may cause such a reset by connecting the chassis to a separate reprogramming box (not shown) that generates the appropriate reprogramming signal.

Also, to avoid triggering the shut down of a printer programmed to read a date code on the chip to avoid printing with ink beyond its useful shelf life, the reset operation in all embodiments may also trigger a date reset in the chip.

In some printers programmed to a very high level of selectivity of cartridge acceptance, error circuitry may be provided to verify that the chip in an inserted cartridge is not defective. This may use techniques of attempting to read, write, and/or erase various sectors of the chip's memory, and read to ensure that each sector responded as expected. For such a printer, the cartridge memory chip will have emulation capability to emulate the needed functions, while retaining the ability to reset the ink level state as needed.

In another alternative embodiment, a kit may be provided that includes a single chassis and multiple ink reservoirs, or a single chassis and reservoir and a refill bottle for refilling; the reservoir. In either embodiment, the operation may proceed as above, or may use a chip programmed to indicate an initial ink volume equal to the volume of all reservoirs in the kit of the entire refill bottle contents. Thus, the ink level indicator would not inform when a single reservoir required replacement or refill, but would indicate when the entire kit was reaching depletion.

While the invention is described in terms of preferred and alternative embodiment, the following claims are not intended to be so limited.

We claim:

1. A replaceable ink cartridge for an ink jet printing system having an ink supply station with an ink receptacle and a printer electrical connector, the cartridge comprising:

a chassis removably matable with the ink supply station, the chassis defining an ink passage and including a cartridge electrical connector matable with the printer electrical connector, the chassis having a cavity;

an ink reservoir defining a chamber containing a supply of ink of a selected volume, wherein the ink reservoir has an ink outlet registered with the ink passage and is removably placeable within the cavity of the chassis;

a memory element coupled to the cartridge electrical connector for generating a signal relating to a volume of ink in the ink reservoir; and a reset circuit, the reset circuit operable to cause at least a portion of the memory element to be reset each time an ink reservoir is inserted into the chassis to enable printing by the printing system after the memory element is reset.

2. The cartridge of claim 1 wherein the cartridge electrical connector includes a plurality of lines including a power input line, a ground line, and a signal line, and wherein the signal line is connected directly to at least one of the other lines.

3. The cartridge of claim 1 wherein the reset circuit includes a reset switch connected to the memory element and wherein the memory element is operable in response to activation of the reset switch to generate a signal indicating that the cartridge is full of ink.

4. The cartridge of claim 1 wherein the chassis defines a chamber receiving at least a portion of the ink reservoir.

5. The cartridge of claim 1, wherein the ink outlet extends through the ink passage, such that the ink outlet is directly connectable to the ink receptacle.

6. The cartridge of claim 1 wherein the chassis and the ink reservoir comprise a flat, rectangular body defining a major plane, and wherein the ink passage and the cartridge electrical connector are located along a common edge of the body, and spaced apart from each other.

7. The cartridge of claim 1 wherein the ink reservoir is removably connected to the chassis, such that it may be replaced upon depletion without requiring replacement of the chassis.

8. The cartridge of claim 1, wherein the memory element is reset each time the ink reservoir is replaced.

9. The cartridge of claim 1, wherein the memory element is reset each time the ink reservoir is refilled.

10. A printing system comprising:

an ink jet printer defining an ink supply station with an ink receptacle and a printer electrical connector;

a replaceable ink cartridge, the ink cartridge comprising:

a chassis removably matable with the ink supply station, the chassis defining an ink passage and including a cartridge electrical connector matable with the printer electrical connector, the chassis having a cavity;

an ink reservoir defining a chamber containing a supply of ink of a selected volume, wherein the ink reservoir has an ink outlet registered with the ink passage and is removably placeable within the cavity of the chassis;

a memory element coupled to the cartridge electrical connector for generating a signal relating to a volume of ink in the ink reservoir; and a reset circuit, the reset circuit operable to cause at least a portion of the memory element to be reset each time an ink reservoir is inserted into the chassis to enable printing by the printing system after the memory element is reset.

11. The printing system of claim 10 wherein the ink reservoir is removably connected to the chassis, such that it may be replaced upon depletion without requiring replacement of the chassis.

12. The printing system of claim 10, further comprising a cartridge kit for holding the ink cartridge and at least a second ink reservoir matable with the chassis.

13. The printing system of claim 10, further comprising a controller contained within a housing for the ink jet printer, wherein the controller and the ink cartridge are separately contained in the housing.

14. A method of servicing an ink jet cartridge removable from a printer, the ink cartridge including a chassis and a removable ink reservoir, the method comprising:

removing the cartridge from the printer;

removing the ink reservoir from the chassis;

refilling the ink reservoir;

installing the ink reservoir in the chassis;

installing the cartridge into the printer; and generating an ink level signal to permit operation of the printer each time the cartridge is replenished with ink.

15. The method of claim 14 further comprising determining that the ink reservoir is depleted before removing the chassis and the ink reservoir from the printer.

16. The method of claim 14 wherein the printer includes a plurality of electrical lines connectable to the chassis, and wherein generating an ink level signal comprises making an electrical connection between at least two of the electrical lines.

17. The method of claim 14 further comprising resetting an ink level indicator on the chassis.

18. The method of claim 17 wherein the ink level indicator is decrementable by the printer in response to operation of the printer to estimate ink usage, and wherein resetting the ink level indicator comprises setting the indicator to a level corresponding to a full supply of ink.

* * * * *